US010875757B2

(12) United States Patent
Lambrecht et al.

(10) Patent No.: US 10,875,757 B2
(45) Date of Patent: Dec. 29, 2020

(54) BEVERAGE EXTRACTOR FOR SPARKLING BEVERAGES

(71) Applicant: Coravin, Inc., Burlington, MA (US)

(72) Inventors: Gregory Lambrecht, Natick, MA (US); Robert Kevin Moore, Natick, MA (US)

(73) Assignee: Coravin, Inc., Bedford, MA (US)

( * ) Notice: Subject to any disclaimer, the term of this patent is extended or adjusted under 35 U.S.C. 154(b) by 0 days.

(21) Appl. No.: 16/531,480

(22) Filed: Aug. 5, 2019

(65) Prior Publication Data

US 2019/0352163 A1 Nov. 21, 2019

Related U.S. Application Data

(62) Division of application No. 15/353,123, filed on Nov. 16, 2016, now Pat. No. 10,414,643.
(Continued)

(51) Int. Cl.
*B67D 1/04* (2006.01)
*B67D 1/00* (2006.01)
(Continued)

(52) U.S. Cl.
CPC ..... *B67D 1/0406* (2013.01); *B67D 1/0003* (2013.01); *B67D 1/0009* (2013.01);
(Continued)

(58) Field of Classification Search
CPC .. B67D 1/0406; B67D 1/0412; B67D 1/0418; B67D 1/0456; B67D 1/0801; B67D 1/0808; B67D 1/0885
(Continued)

(56) References Cited

U.S. PATENT DOCUMENTS 2,160,501 A ‡ 5/1939 Hedges ..... B67D 1/04 137/12.5
3,332,421 A * 7/1967 King ..... A61J 1/2096 604/88
(Continued)

FOREIGN PATENT DOCUMENTS

EP 2 017 195 A1 1/2009

OTHER PUBLICATIONS

International Search Report and Written Opinion for International Application No. PCT/U52016/062227, dated Jun. 28, 2017.‡
(Continued)

*Primary Examiner* — Timothy L Maust
(74) *Attorney, Agent, or Firm* — Wolf, Greenfield & Sacks, P.C.

(57) ABSTRACT

A system and method for dispensing sparkling and other pressurized beverages from a container. Sparkling wine and other beverages may be dispensed without removing a cork or other closure. One or more needles may be inserted through the closure and sparkling beverage dispensed through the one or more needles. The one or more needles may be inserted at an angle to the vertical or axis of the bottle opening in which the closure is positioned, e.g., to avoid contact with a metal retainer on the closure. Dispensed beverage may be directed to a pressurized reservoir to help maintain or recover carbonation prior to dispensing.

38 Claims, 8 Drawing Sheets

Related U.S. Application Data

(60) Provisional application No. 62/256,254, filed on Nov. 17, 2015.

(51) Int. Cl.
*B67D 1/08* (2006.01)
*B67D 1/12* (2006.01)

(52) U.S. Cl.
CPC ..... *B67D 1/0082* (2013.01); *B67D 1/0412* (2013.01); *B67D 1/0418* (2013.01); *B67D 1/0456* (2013.01); *B67D 1/0801* (2013.01); *B67D 1/0808* (2013.01); *B67D 1/0885* (2013.01); *B67D 1/1252* (2013.01); *B67D 2001/0092* (2013.01); *B67D 2001/0481* (2013.01); *B67D 2001/0487* (2013.01); *B67D 2001/0812* (2013.01); *B67D 2001/0822* (2013.01); *B67D 2001/0824* (2013.01)

(58) Field of Classification Search
USPC ..... 141/319, 329, 330
See application file for complete search history.

(56) References Cited

U.S. PATENT DOCUMENTS

| | | | | |
|---|---|---|---|---|
| 3,941,167 | A * | 3/1976 | Haury-Wirtz | A61K 9/0019 141/1 |
| 4,011,971 | A | 3/1977 | Haydon | |
| 5,139,179 | A * | 8/1992 | Cecil | B67D 1/0412 222/399 |
| 7,712,637 | B2 ‡ | 5/2010 | Lambrecht | B67D 1/0412 141/17 |
| 8,033,431 | B2 * | 10/2011 | Sommerfield | B67D 1/0412 222/129 |
| 8,910,829 | B2 ‡ | 12/2014 | Lazaris | B67D 1/0418 141/330 |
| 9,016,517 | B2 * | 4/2015 | Craft | B67D 1/0418 222/23 |
| 9,133,008 | B2 * | 9/2015 | Rider | B67D 1/0412 |
| 9,181,021 | B2 * | 11/2015 | Manera | B65D 83/32 |
| 10,414,643 | B2 * | 9/2019 | Lambrecht | B67D 1/0801 |
| 2006/0283523 | A1 ‡ | 12/2006 | Gadzic | B67D 7/02 141/330 |
| 2008/0314930 | A1 * | 12/2008 | Green | B67D 3/0035 222/185.1 |
| 2010/0006603 | A1 * | 1/2010 | Weinberg | B67D 1/0885 222/152 |
| 2011/0204093 | A1 * | 8/2011 | Lee | B67D 1/0418 222/152 |
| 2011/0253251 | A1 * | 10/2011 | Mudd | A61M 5/158 141/2 |
| 2013/0119085 | A1 ‡ | 5/2013 | Nishino | B67D 1/04 222/91 |
| 2013/0306673 | A1 | 11/2013 | Hedges et al. | |
| 2014/0252046 | A1 | 9/2014 | Rider et al. | |
| 2017/0137275 | A1 | 5/2017 | Lambrecht et al. | |

OTHER PUBLICATIONS

International Preliminary Report on Patentability for International Application No. PCT/U52016/062227, dated May 31, 2018.‡
Invitation to Pay Additional Fees for Application No. PCT/US2016/062227, dated Feb. 3, 2017.‡
Extended European Search Report for European Application No. EP 19191439.9, dated Oct. 31, 2019.
Invitation to Pay Additional Fees for International Application No. PCT/US2016/062227, dated Feb. 3, 2017.
International Search Report and Written Opinion for International Application No. PCT/US2016/062227, dated Jun. 28, 2017.
International Preliminary Report on Patentability for International Application No. PCT/US2016/062227, dated May 31, 2018.

* cited by examiner
‡ imported from a related application

BEVERAGE EXTRACTOR FOR SPARKLING BEVERAGES

RELATED APPLICATION

This application is a division of U.S. application Ser. No. 15/353,123 filed Nov. 16, 2016, which claims priority under 35 U.S.C. § 119(e) to U.S. Provisional Application No. 62/256,254 filed Nov. 17, 2015, each of which is herein incorporated by reference in its entirety.

BACKGROUND OF INVENTION

This invention relates generally to the dispensing or other extraction of fluids from within a container, e.g., in the dispensing of sparkling wine from a wine bottle.

SUMMARY OF INVENTION

One or more embodiments in accordance with aspects of the invention allow a user to withdraw or otherwise extract a beverage, such as wine, from within a bottle that is sealed by a cork, plug, elastomeric septum or other closure without removing the closure. In some cases, removal of liquid from such a bottle may be performed one or more times, yet the closure may remain in place during and after each beverage extraction to maintain a seal for the bottle. Thus, the beverage may be dispensed from the bottle multiple times and stored for extended periods between each extraction with little or no effect on beverage quality. In some embodiments, little or no gas, such as air, which is reactive with the beverage, may be introduced into the bottle either during or after extraction of beverage from within the bottle. Thus, in some embodiments, a user may withdraw wine from a wine bottle without removal of, or damage to, the cork, and without allowing air or other potentially damaging gasses or liquids entry into the bottle.

In one aspect of the invention, a sparkling beverage dispensing system is provided for use with a container, such as a sparkling wine bottle, having an opening with a closure positioned in the opening and a cap and wire retainer securing the closure to the container. The system may include at least one needle arranged to penetrate through the closure such that a distal end of the needle is positioned inside of the container. Thus, the needle may be arranged to receive beverage from the container for dispensing. A needle guide may be arranged to engage the container and guide the at least one needle in penetrating through the closure. In some cases, the at least one needle and the needle guide may be arranged such that the at least one needle enters the closure at an angle of 5 degrees to 70 degrees relative to a longitudinal axis of the container. For example, the at least one needle may be straight, and may be guided along a linear path through the closure by the needle guide that is arranged at an angle of 5 degrees to 45 degrees relative to a longitudinal axis of the container as the at least one needle is inserted through the closure. In other embodiments, the at least one needle may be curved. The curved needle and needle guide may be arranged so that the distal end of the curved needle enters the closure at an angle of 5 degrees to 70 degrees and then follows a curved path through the closure until the distal end of the curved needle exits the closure at the interior of the container. In some cases, the needle may have a constant curvature, although a variable curvature is possible. Arranging the needle to enter the closure at an angle allows access to a sparkling wine bottle without removing a wire cage and metal cap that are often used to retain a closure in the bottle opening. Alternately, the wire cage and cap could be removed from the bottle and the at least one needle inserted through the closure at any suitable angle, including along the longitudinal axis of the container. In some cases, the metal cap can be removed and the wire cage replaced on the bottle to help keep the closure in place while the at least one needle is inserted through the closure and used to dispense beverage from the container. With the at least one needle having penetrated the closure, at least one valve may be fluidly coupled to the at least one needle to control beverage flow out of the container via the at least one needle to a dispensing outlet. For example, after the at least one needle is inserted through a cork, the at least one valve may be opened and pressure inside of the container may drive the flow of sparkling beverage through the at least one needle and from the at least one valve.

In one embodiment, the at least one needle is arranged to penetrate a cork closure of a sparkling wine bottle and be withdrawn from the cork closure such that the cork closure reseals. Thus, one portion of a volume of beverage in the container may be dispensed via the at least one needle, and the at least one needle withdrawn so that the cork reseals the container, e.g., allowing storage of the remaining beverage under pressurized conditions that preserve a desired level of carbonation. Prior to withdrawing the needle, pressurized gas may be introduced into the container, e.g., at a level suitable to help maintain a desired carbonation for subsequent consumption.

In one embodiment, the system also includes a reservoir arranged to fluidly couple with the dispensing outlet and hold dispensed beverage under pressure. The reservoir can have any of a number of different shapes and/or volumes, e.g., the reservoir may have a volume between 10 ml and 500 ml, enabling the pouring of a taste, a glass, two glasses, or any other portion of the sparkling beverage in the bottle. The reservoir may be fixedly coupled to the beverage extraction system, or all or a portion of the reservoir could be releasably coupled to the beverage extraction system. Thus, beverage may be dispensed into the reservoir, and then the reservoir removed from the remainder of the system for dispensing beverage from the reservoir. For example, the reservoir could be opened by the user by unthreading or uncapping a lid to the reservoir to allow beverage in the reservoir to be poured into a glass. Alternatively, a valve in the reservoir could open to allow the pouring of the beverage once a specific volume or pressure within the reservoir has been reached. Such a valve could alternatively be opened after a specific time of filling.

In some embodiments, for example, the reservoir may be fluidly coupled to the dispensing outlet so that a pressure in the reservoir equalizes with a pressure in the container, which may help retain carbonation of the beverage. In some cases, the reservoir may be arranged to vent to ambient pressure before or at a time of dispensing the beverage from the reservoir to a user's cup, e.g., using a pressure relief valve or a flow restrictor. Venting of the beverage, e.g., in a relatively slow fashion, may also aid in retaining carbonation. The reservoir may include a dispensing valve arranged to open to vent the reservoir and to dispense the beverage from the reservoir, e.g., beverage may be dispensed from a valved outlet at a bottom of the reservoir.

In some embodiments, the system includes a source of pressurized gas, and the at least one valve includes a gas control valve to allow a flow of pressurized gas from the source of pressurized gas into the container via the at least one needle. This may allow the container to be re-pressurized after beverage is dispensed from the container, e.g., so that beverage may be stored under pressure or additional beverage dispensed from the container. In some cases, the at least one valve includes a beverage dispensing valve to control flow of beverage from the at least one needle to the dispensing outlet, and the gas control valve may permit flow of pressurized gas only when the beverage dispensing valve is closed. The at least one valve may include a normally closed beverage dispensing valve that prevents flow of beverage from the at least one needle to the dispensing outlet absent user action to open the normally closed valve. Thus, in some cases control of the at least one valve may be manually performed by the user. Alternatively, one or more valves may be automatically controlled, incorporating sensing of the tip-angle of the bottle, pressure within the bottle, pressure within the reservoir, and/or fill level of the reservoir to control valve operation.

In another aspect of the invention, a sparkling beverage dispensing system is provided for use with a container holding a beverage under pressure above ambient and having a closure at an opening of the container. The system may include at least one conduit arranged to deliver pressurized gas into the container and to receive beverage from the container for dispensing. In some embodiments, the at least one conduit may include a needle that can be inserted through a closure of the container. The needle may include one or more lumens to conduct the flow of gas and/or beverage. At least one valve may be fluidly coupled to the at least one conduit to control beverage flow out of the container via the at least one needle to a dispensing outlet, and a reservoir may be arranged to fluidly couple with the dispensing outlet and receive beverage dispensed from the dispensing outlet. The reservoir may be arranged to hold dispensed beverage under pressure, e.g., the reservoir may be fluidly coupled to the dispensing outlet so that a pressure in the reservoir can equalize with a pressure in the container. The reservoir may be configured as described above, e.g., arranged to vent to ambient pressure before or at a time of dispensing the beverage from the reservoir to a user's cup, including a dispensing valve arranged to open to vent the reservoir and dispense the beverage in the reservoir, arranged to vent pressure in the reservoir at a rate of no more than 5 psi/second when in a closed state, arranged so beverage enters the reservoir at a bottom of the reservoir, and so on.

A beverage extractor may be secured to the neck of the bottle or other container, such as by clamping a portion of the extractor to the bottle neck or bottle closure, and a needle of the beverage extractor may be inserted through the closure (such as a cork of a wine bottle) so that a distal end of the needle is positioned inside of the bottle. Thereafter, pressurized gas may be injected into the bottle via the needle. The injected gas may be pressure regulated, e.g., to a pressure of 15-110 psi (1-7.6 bar), or not regulated. For example, pressure in the bottle may allow beverage to flow through the needle and out of the bottle. In some embodiments, the extractor needle may include two lumens or two needles, one for gas and another for beverage, e.g., so that gas may be injected simultaneously with beverage flow out of the bottle.

In another aspect of the invention, a system for dispensing sparkling beverages may use a needle, a reservoir, and a source of pressurized gas such that two different pressure levels of gas may be provided. Such a system could provide a second pressure of gas into the bottle to aid in dispensing the beverage from the bottle and/or to re-pressurize the bottle once an amount of beverage is removed. Re-pressurization could be to a level equivalent to, less than, or higher than the original pressure of the bottle prior to withdrawal of any beverage. Re-pressurization could be performed during the beverage extraction process, after removing a desired amount of beverage, or both. The system could supply a first pressure to pressurize the reservoir prior to, during, and/or following extraction of the beverage from the bottle into the reservoir. Pressurizing the reservoir may aid in re-carbonating beverage in cases where carbonation is lost during extraction. In some embodiments, a second pressure used to pressurize or re-pressurize the bottle for storage may be between 1 and 7 atm (1 and 7.1 bar). A first pressure used to pressurize the reservoir may be between 3-10 atm (3 and 10.1 bar).

Where two pressure levels are provided, the two pressures may be supplied from two separate sources of gas, each controlled by its own regulator. Alternatively, a single source of pressurized gas may be used, with lines to each of two separate regulators. In a further embodiment, a single source of pressurized gas may be used as well as a dual stage regulator, where the first stage of the dual stage regulator regulates the pressure to the first pressure used to pressurize the reservoir, while the second stage regulates the pressure to the second pressure used to pressurize the bottle.

In further embodiments, the reservoir could incorporate a variety of sensors. One such sensor could be a pressure sensor fluidly coupled to the reservoir. Such a sensor could be used to control the opening and closing of a valve leading to a pressurized source of gas to control the pressure within the reservoir. The pressure sensor could incorporate a display enabling the user to determine the optimal pressure within the reservoir. Another sensor could detect the fill level of the reservoir which could enable the extraction of specific amounts of beverage from the bottle. A pressure sensor could also be incorporated to detect the pressure within the container before, during, and/or after beverage extraction.

Various exemplary embodiments of the device are further depicted and described below.

BRIEF DESCRIPTION OF THE DRAWINGS

Aspects of the invention are described with reference to various embodiments, and to the figures, which include.

DETAILED DESCRIPTION

Aspects of the invention are described below with reference to illustrative embodiments, but it should be understood that aspects of the invention are not to be construed narrowly in view of the specific embodiments described. Thus, aspects of the invention are not limited to the embodiments described herein. It should also be understood that various aspects of the invention may be used alone and/or in any suitable combination with each other, and thus various embodiments should not be interpreted as requiring any particular combination or combinations of features. Instead, one or more features of the embodiments described may be combined with any other suitable features of other embodiments.

In one aspect of the invention, a method and apparatus are provided to access sparkling wine or other beverage in a bottle or other container without removing the cork or other closure. Moreover, the sparkling beverage may be accessed from the container without removing a metal cap and wire retainer commonly found on sparkling wine bottles. In some cases, only a portion of the sparkling beverage may be dispensed from the container, and the container resealed under pressure to maintain carbonation, without removing a cork or other closure of the container. In some embodiments, the sparkling beverage may be dispensed into a reservoir that maintains pressure on the beverage, helping to maintain carbonation during the extraction process. Thereafter, the beverage may be dispensed from the reservoir with reduced carbonation loss.

Figure 1:
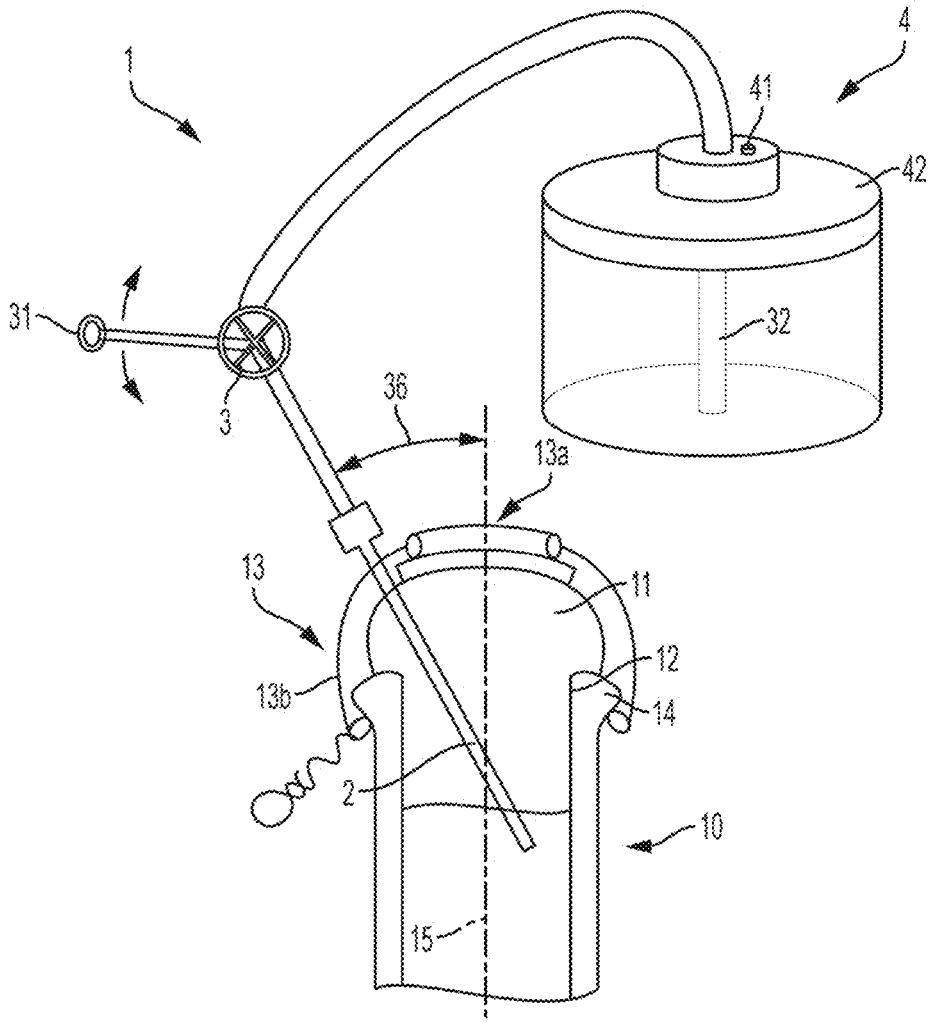
FIG. 1 shows a schematic view of a beverage extraction device in an illustrative embodiment.

FIG. 1 shows a schematic view of an apparatus 1 for extracting a sparkling beverage from a container 10 that has a cork or other closure 11 that seals an opening 12 of the container. In this embodiment, a metal cap and wire retainer 13 are provided over the cork 11 so that the cork 11 is maintained in place in the opening 12. As is known, the metal cap portion 13*a* of a metal cap and wire retainer 13 is positioned over a top of the cork 11, and the wire portion 13*b* extends over the cap portion 13*a* and engages with a lip 14 of the container opening 12. In accordance with an aspect of the invention, a needle 2 or other penetrating conduit may be inserted through the cork 11 so that a distal end of the needle 2 is positioned inside of the container 10 without removing the metal cap and wire retainer 13. The needle 2 may have one or more lumens so that the needle 2 provides fluid communication between the interior of the container 10 and the exterior, and thus allows beverage to be extracted from the container 10 without removing the cork 11 or the metal cap and wire retainer 13. Of course, in other embodiments, the wire retainer 13 and metal cap may be removed to allow a needle 2 to penetrate the cork 11 in a vertical direction or any other desired angle. In some cases, only the metal cap may be removed and the wire retainer 13 kept on the bottle to hold the cork 11 in place. Alternately, the needle 2 may be arranged to penetrate through the metal cap, or the cap may be pre-drilled or punched to allow the needle to pass through in a vertical or other orientation.

In accordance with an aspect of the invention, the needle 2 may be initially inserted into the cork 11 at a location adjacent to a periphery of the metal cap portion 13*a*, e.g., so that the needle 2 enters the cork 11 at an angle 36 to a longitudinal axis 15 of the container 10 of at least 5 degrees, such as about 5 to 70 degrees, e.g., about 30 degrees. This arrangement has been found to allow for the insertion of the needle 2 through the cork 11 without removing the metal cap and wire 13. As a result, the beverage can be extracted while reducing the chance that the cork 11 will separate from the container 10, e.g., because the metal cap and wire retainer 13 need not be removed. As is discussed in more detail below, the needle 2 may be guided in its movement through the cork 11 by a needle guide. The needle guide may include a body that is mounted to or otherwise engaged with the container 10 and includes one or more openings arranged to guide movement of the needle 2 through the cork 11 at a suitable location and angle while helping reduce the chance that the needle 2 will buckle or bend during insertion. In some embodiments, the needle 2 may be straight and pass through the cork 11 along a linear path, while in other embodiments the needle 2 may be curved and follow a curved path through the cork 11. Note that different needle guides may be provided for different cork 11 and metal cap and wire retainer 13 arrangements. For example, some cork 11 and metal cap/wire 13 configurations may require a needle insertion angle within a first angle range relative to the container longitudinal axis 15, whereas other cork and metal cap/wire configurations may require other angle ranges.

Generally, if a needle 2 is inserted through a cork 11 of a sparkling beverage container 10 like that shown in FIG. 1, relatively high pressure gas and/or beverage may be ejected from the proximal end of the needle 2 if the needle 2 is open to flow. In this embodiment, the lumen(s) of the needle 2 is fluidly coupled to a valve 3 that is normally closed. By having the needle 2 coupled to a normally closed valve 3 prior to insertion of the needle 2 through the cork 11, flow through the needle 2 can be prevented, helping to retain beverage and gas in the container 10. In another embodiment, the needle 2 need not be fluidly coupled to a valve 3, and may have a closure, such as a cap or septum, at a proximal end that prevents flow through the needle 2. Thus, the needle 2 can be inserted through the cork 11 without being fluidly coupled to a valve 3 and without loss of beverage and/or gas from the container 10.

The valve 3 may include an actuator, such as a lever 31 or other element, to allow a user to open and close the valve 3. By opening the valve 3, beverage and/or gas in the container 10 may be allowed to flow through the needle 2, to the valve 3, and then to a dispensing outlet 32 (e.g., a tube or other conduit fluidly coupled to the valve 3). As necessary, the container 10 may be tilted, inverted or otherwise positioned so that beverage, rather than gas, is moved into the needle 2. Pressure inside of the container 10 may drive the flow of beverage and/or gas into the needle 2, and may continue until pressure in the container 10 is approximately equal to an ambient pressure. Although not shown in FIG. 1, a source of pressurized gas may be fluidly coupled to the valve 3 and/or needle 2 so as to introduce pressure into the container 10, e.g., after pressure in the container 10 drops to about ambient when beverage is dispensed. The source of pressurized gas may include any suitable components, such as a hand-operated pump bulb, a high pressure gas or two-phase gas and liquid cylinder (e.g., having up to about 3000 psi gas [207 bar] stored in the cylinder) and corresponding receiver to pierce the cylinder as needed and conduct gas flow, a pressure regulator to help ensure that a pressure in the container 10 does not exceed a desired level, such as 20-100 psi (1.4-6.9 bar), one or more valves to control flow of the gas, and so on. To dispense a desired amount of beverage, it may be necessary to dispense beverage until pressure in the container 10 drops to about ambient or some higher pressure that is lower than the original pressure within container 10, then introduce pressurized gas into the container to drive additional flow from then container 10, and again dispense beverage. This process may be repeated as necessary until a desired volume of beverage is dispensed. Alternately, it is possible to introduce pressurized gas into the container 10 simultaneous with dispensing beverage via the needle 2. In such embodiments, a needle 2 having two or more lumens may be desirable, e.g., one or more lumens for gas delivery into the container 10 and one or more lumens for beverage flow out of the container 10.

The inventor has found that dispensing a pressurized, carbonated beverage via a needle tends to cause the beverage to release dissolved gas if the beverage is dispensed from the needle 2 and any associated valve 3 or other conduit into a space under ambient pressure. Hence, in accordance with an aspect of the invention, beverage extracted via a needle 2 is initially dispensed into a reservoir 4 that is arranged to fluidly couple with the dispensing outlet 32 so as to receive the dispensed beverage and hold the beverage under pressure. In some cases, the reservoir 4 may be arranged to receive beverage so as to allow pressure in the reservoir 4 to equalize with pressure in the container 10. This may assist with maintaining a desired carbonation level in the dispensed beverage during and after the extraction process. In accordance with another aspect of the invention, the dispensing outlet 32 may be positioned to discharge beverage into a bottom of reservoir 4 so that beverage enters into a relatively low point in the reservoir 4 and below a surface level of the beverage (at least after a relatively small amount of beverage is dispensed). This may also aid in helping maintain a level of dissolved carbon dioxide or other gas in the beverage. The dispensing outlet 32 may be made removable from the reservoir 4 if desired, e.g., the dispensing outlet 32 may include a tube that may be pulled from an opening of the reservoir 4. The reservoir 4 may include one or more gaskets or other seals to help maintain a suitable pressure-tight engagement between the dispensing outlet 32 and the reservoir 4.

In some embodiments, the reservoir 4 may define a sealed space, but have a vent 41 that permits pressure in the reservoir 4 to leak at a relatively slow rate. The rate of leakage may be relatively low, e.g., at least low enough to allow pressure in the reservoir 4 to be below the pressure in the container 10 when beverage is being dispensed into the reservoir 4. This provides for continuous flow. For example, pressure in the reservoir 4 may leak through the vent at a rate of about 5 psi/second or less. Venting the reservoir 4 slowly may allow the pressure in the reservoir 4 to equilibrate with ambient pressure while maintaining a desired carbonation level of the beverage. Venting can be achieved by employing any of a variety of pressure-relief valves, either set to vent at a specific pressure or with a variable setting which can be adjusted by the user. Alternatively, venting could be accomplished using a flow restrictor, again either tunable or set to a fixed flow resistance. Such a restrictor could simply be a small hole or elongated path exiting the reservoir 4. Such a hole or path could employ a semi-permeable membrane that restricts the flow of liquid, but allows the flow of gas. The flow restrictor or valve could further incorporate a closure mechanism that can be activated either manually or automatically once the desired amount of beverage has been extracted from the container. In some embodiments, pressurized gas, such as carbon dioxide, may be delivered into the reservoir 4 prior to dispensing beverage into the reservoir 4. This may help reduce an amount of oxygen and/or air (mixtures of nitrogen, oxygen and other gases) in the reservoir 4, and thereby help maintain a desired type and amount of dissolved carbon dioxide or other gas in a beverage. In some embodiments, the reservoir 4 may be arranged to have a relatively small or minimum volume prior to beverage dispensing, and arranged such that the beverage holding volume increases with beverage dispensing. Such an arrangement may also help reduce an amount of oxygen or air in the reservoir 4 prior to dispensing. For example, the reservoir may include a movable piston that is moved to minimize a beverage holding volume of the reservoir 4 prior to dispensing. During dispensing, the piston may move as dispensed beverage displaces the piston and enlarges the beverage holding volume. The piston may have a stop that prevents movement of the piston beyond a certain point, and thereby fixes a maximum beverage holding volume of the reservoir 4. By providing a fixed maximum holding volume, the reservoir 4 may be additionally pressurized, as desired to additionally carbonate a beverage in the reservoir 4, for example. During dispensing of the beverage from the reservoir 4, the piston may be moved to force beverage out of the reservoir 4.

Beverage may be dispensed from the reservoir 4 in a variety of different ways. For example, the reservoir may include a lid 42 that can be removed to allow beverage to be poured from the reservoir 4 into a user's cup. Such an arrangement may also provide for venting the reservoir 4 to ambient pressure before or at a time of dispensing the beverage from the reservoir to a user's cup. That is, the lid 42 may engage the reservoir 4 so that as the lid 42 is removed, pressure in the reservoir 4 is vented to ambient pressure at a desired rate. In another embodiment, the reservoir 4 may include a dispensing valve, such as a gate valve or other arrangement, to dispense beverage from the reservoir 4. In some embodiments, beverage may be dispensed from a bottom of the reservoir 4, e.g., a dispensing valve may be located at a bottom wall of the reservoir 4. In other arrangements, the reservoir 4 may include a spigot, e.g., at a sidewall of the reservoir 4, or other components to allow beverage to be dispensed from the reservoir 4. Reservoir 4 can further be designed at a variety of different volumes. They could be sized to become filled or reach equilibrium when specific amounts of sparkling beverage have been poured. For example, they could be sized for a 175 ml or single glass pour. Alternatively they could be sized for a 30 ml taste or a 375 ml half bottle pour simply by varying the enclosed volume of reservoir 4.

After beverage extraction is complete, the needle 2 may be removed from the cork 11. In some embodiments, the needle is arranged to penetrate a cork closure of a sparkling wine bottle and be withdrawn from the cork closure such that the cork closure reseals. That is, the needle may be sized and shaped so that once the needle is removed from the cork, the cork itself reseals the opening formed by the needle so that pressure may be maintained in the container. As a result, gas may be injected into the container 10 after dispensing is complete to establish a suitably high pressure in the container 10 to maintain a desired carbonation level. The needle 2 may be removed, and the cork 11 may reseal so that the high pressure conditions in the container, e.g., 20-100 psi (1.4-6.9 bar), are maintained over an extended period, such as weeks or months.

Figure 2:
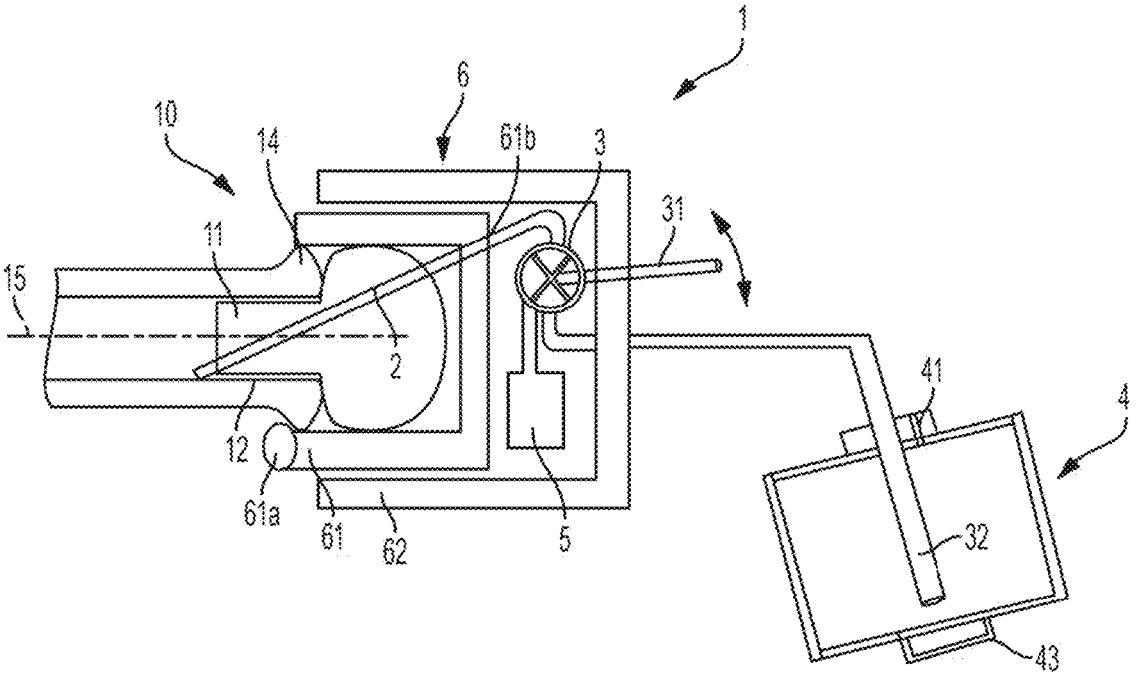
FIG. 2 shows in illustrative embodiment of a beverage extraction device with a needle guide.

FIG. 2 shows a schematic diagram of another beverage extraction apparatus 1. In this embodiment, the apparatus 1 includes a housing 6 that can be engaged with the container 10 and supports portions of the apparatus 1 such as a valve 3, dispensing outlet 32, and so on. As noted above, where a cork 11 has a metal cap and wire retainer 13, a needle 2 is preferably guided to enter and pass through the cork 11 at a specific location and angle relative to the longitudinal axis 15 of the container. In this embodiment, a needle guide 61 may be engaged with the neck of the container 10 at the opening 12 so that the needle 2 can be stably and reliably guided in its motion through the cork 11. The needle guide 61 may be engaged with the container 10 in different ways, such as by a clamp, strap, sleeve, etc., and in this embodiment includes a rectangular box element with a hook 61*a* to engage under the lip 14 of the container opening 12. For example, the hook 61*a* may be first positioned under the lip 14, and then the needle guide 61 rotated about the hook 61*a* relative to the container 10 so that the cork 11 is captured inside of the box element. A strap or other component (not shown) may be used to secure the needle guide 61 in place, if desired, e.g., to allow a user to manipulate the container 10 while maintaining the apparatus 1 secure in place without additional support. For example, a user may hold the container 10 as if pouring from the container 10, and the apparatus 1 may remain securely attached to the container 10 without additional support by the user. The needle guide 61 includes an opening 61*b* through which the needle 2 may be inserted to guide the needle 2 in its movement through the cork 11. The needle 2 may be inserted through the cork 11 alone, or may be attached to another portion of the apparatus 1, such as an upper housing 62, while being inserted into the needle guide opening 61*b* and the cork 11. The needle guide 61 and upper housing 62 may be secured together once the needle 2 is inserted, e.g., to help keep the needle 2 in place. In some embodiments, the needle guide 61 and upper housing 62 may be attached together so that movement of the upper housing 62 is guided relative to the needle guide 61. For example, the needle guide 61 and upper housing 62 may be engaged by one or more rails, a linkage, or other arrangement that guides motion of the upper housing 62 and attached needle 2 relative to the needle guide 61. Thus, a user may be allowed to grasp the upper housing 62 and move the upper housing 62 relative to the needle guide 61 to insert the needle 2 into the cork 11.

In this embodiment of FIG. 2, the apparatus 1 also includes a source of pressurized gas 5, such as a compressed gas cylinder, pump, or other device arranged to provide gas under pressure. The gas source 5 may be coupled to the valve 3 (which may include two or more valve elements or positions to control gas and beverage flow) so that gas may be provided from the gas source 5 into the container 10 via the needle 2. For example, the valve 3 may be normally closed to both gas and beverage flow, and operation of a lever 31 or other actuator may cause the valve 3 to allow gas flow from the gas source 5 to the needle 2 and into the container 10. Beverage flow may be prevented, or permitted, while gas is introduced into the container, though in this embodiment beverage flow is prevented while gas is injected into the container 10. A regulator (not shown) may be included in the gas source 5, e.g., so that a desired pressure may be established in the container 10, such as a pressure between 20 and 100 psi (1.4-6.9 bar). Operation of the lever 31 or other actuator may stop gas flow and permit beverage flow from the container 10 to the reservoir 4 via the dispensing outlet 32. For example, after mounting the apparatus 1 to the container 10 and inserting the needle 2 through the cork 11, a user may manipulate the actuator 31 to cause beverage to be dispensed into the reservoir 4. Once beverage flow slows or stops due to pressure equalization between the reservoir 4 and container 10, or pressure drop in the container 10, the user may manipulate the actuator 31 to stop beverage flow and inject pressurized gas into the container 10. Once a desired pressure level is established in the container 10, the actuator 31 may be manipulated again to stop gas flow, and permit beverage to be dispensed into the reservoir 4. The reservoir 4 may function as described above, and in this embodiment the reservoir 4 includes a dispensing valve 43 at a bottom of the reservoir 4 to allow beverage to be dispensed from the bottom of the reservoir 4. The dispensing valve 43 may be a gate valve, ball valve, flapper valve or other arrangement to suitably control beverage flow. For example, after a desired amount of beverage is dispensed into the reservoir 4, the reservoir 4 may be vented to ambient pressure and the dispensing valve 43 opened to discharge beverage under the force of gravity.

Figure 3:
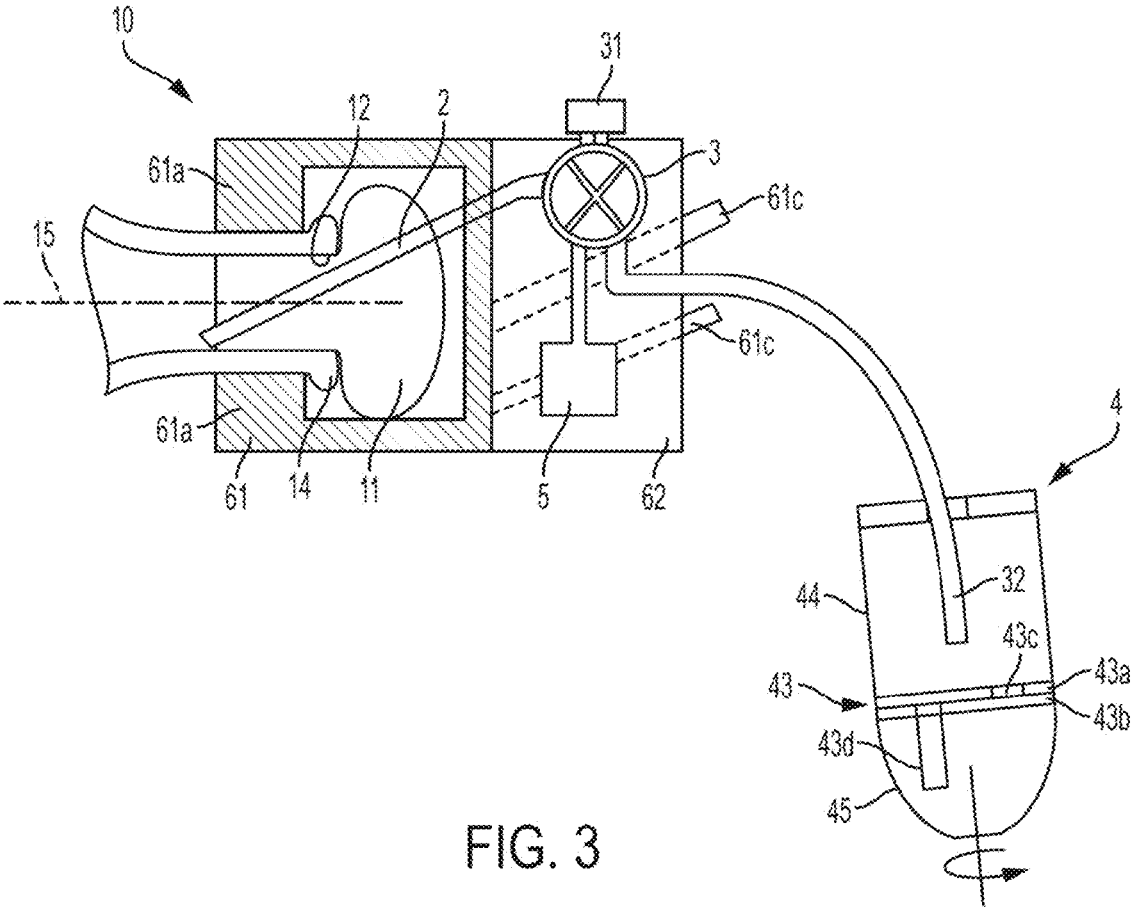
FIG. 3 shows another illustrative embodiment of a beverage extraction device with a twist to dispense reservoir.

FIG. 3 shows schematic diagram of an illustrative beverage dispensing apparatus 1 in another embodiment. In this configuration, the needle guide 61 includes a pair of hooks 61*a* that engage with opposite sides of the lip 14 of the container 10. The needle guide 61 may be engaged with the container by sliding the container neck and cork 11 into the internal space of the needle guide 61 (e.g., one side of the needle guide 61 may be open to allow the guide 61 to be slid onto the container 10 with the hooks 61*a* below the lip 14 of the container neck). Alternately, one or more of the hooks 61*a* may be made movable to allow the guide 61 to be pushed down over the cork 11 and the hook(s) 61*a* engaged to lock the guide 61 in place, or the hooks 61*a* may be made resilient so that the hooks 61*a* flex outwardly when the needle guide 61 is pushed onto the container 10, etc. Also, in this embodiment the needle 2 is mounted to an upper housing 62 and the upper housing 62 is guided in motion relative to the needle guide 61 by one or more rods 61*c* that extend through corresponding guide openings in the upper housing 62. Another difference in relation to other embodiments is that the valve 3 includes an actuator 31 in the form of a push button, although other arrangements are possible to cause the valve to operate between an off state, a gas on/beverage off state, and a gas off/beverage on state. The valve 3 may be operated manually, electromechanically, or in other ways, and may operate under automated control.

Figure 4:
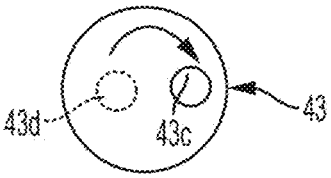
FIG. 4 shows a top view of the twist dispenser of FIG. 3.

This embodiment of FIG. 3 also includes a reservoir 4 that includes upper and lower portions 44, 45. During use, beverage is dispensed from the dispensing outlet 32 into the upper portion 44 to a desired level. Thereafter, a dispensing valve 43 may be opened by rotating the lower portion 45 relative to the upper portion 44 so that beverage flows into the lower portion 45 and out to a user's cup. The dispensing valve 43 may take different forms but in this embodiment includes a pair of plates that rotate relative to each other. An upper plate includes an opening 43*c* and the lower plate includes an outlet 43*d*. When the plates are rotated so the opening 43*c* is aligned with the outlet 43*d* as schematically shown in FIG. 4, beverage may flow from the upper portion 44 to the lower portion 45. Otherwise, with the opening 43*c* and outlet 43*d* unaligned, the dispensing valve 43 is closed and beverage is retained in the upper portion 44.

Regarding needles that may be used with aspects of the invention, it has been found that needles having a smooth walled exterior, pencil point or Huber point needle of 15 gauge or higher are effective to penetrate through a wine bottle cork or other closure, while sealing effectively with the cork to prevent the ingress or egress of gases or fluids during beverage extraction. Moreover, such needles allow the cork to reseal after withdrawal of the needle, allowing the bottle and any remaining beverage to be stored for months or years without abnormal alteration of the beverage flavor. Further, such needles may be used to penetrate a foil cover or other wrapping commonly found on wine bottles and other bottles, though not necessarily a metal cap of a cork retainer. Thus, the needle may penetrate the foil cover or other element as well as the closure, eliminating any need to remove the foil or other wrapping prior to beverage extraction. Other needle profiles and gauges are also usable with the system.

While in the above embodiments, a user moves the needle to insert/remove a needle with respect to a bottle closure, a manual or powered drive mechanism may be used to move a needle relative to a cork or other closure. For example, the rods 61*c* in FIG. 3 may include a toothed rack, and a powered pinion gear may engage the rack and serve to move the upper housing 62 relative to the needle guide 61. The pinion may be powered by a user-operated handle, a motor, or other suitable arrangement. In another embodiment, the needle may be moved by a pneumatic or hydraulic piston/cylinder, e.g., which is powered by pressure from the gas cylinder 5 or other source. In an alternate embodiment, the needle and access system may be fixed to a table or wall and the user manipulates the bottle such that as the bottle is moved against the needle, the needle passes through the cork.

A needle used in a beverage extraction device may be a smooth exterior walled, cylindrical needle with a non-coring tip that can be passed through a cork without removing material from the cork. One non-coring tip is a pencil-tip that dilates a passageway through the cork, although deflected-tip and stylet needles have also been found to work properly and could be used in alternative embodiments. The pencil-tip needle preferably has at least one lumen extending along its length from at least one inlet on the end opposite the pencil-tip and at least one outlet proximal to the pencil-tip. As shown above, a needle outlet may be positioned in the side-wall of the needle at the distal end of the needle, although proximal of the extreme needle tip. Multiple relatively small holes may be provided in the needle sidewall.

With the correct needle gauge, it has been found that a passageway (if any) that remains following removal of the needle from a cork self-seals against egress or ingress of fluids and/or gasses under normal storage conditions. Thus, a needle may be inserted through a closure to extract beverage, and then be removed, allowing the closure to reseal such that beverage and gas passage through the closure is prevented. While multiple needle gauges can work, preferred needle gauges range from 16 to 22 gauge, with an optimal needle gauge in some embodiments being between 16 and 20 gauge. These needles gauges may offer optimal fluid flow with minimal pressures inside the bottle while doing an acceptably low level of damage to the cork even after repeated insertions and extractions.

Multiple needle lengths can be adapted to work properly in various embodiments, but it has been found that a minimum needle length of about 1.5 inches (3.8 cm) is generally required to pass through standard sparkling wine bottle corks. Needles as long as 9 inches could be employed, but the optimal range of length for some embodiments has been found to be between 1.8 and 2.6 inches (4.6 and 6.6 cm). (Needle length is the length of a needle that is operable to penetrate a closure and/or contact a needle guide for guidance in moving through the closure.) The needle may be fluidly connected to the valve directly through any standard fitting (e.g. NPT, RPT, Leur, quick-connect or standard thread) or alternatively may be connected to the valve through an intervening element such as a flexible or rigid tube. When two or more needles are used, the needle lengths may be the same or different and vary from 0.25 inches to 10 inches (0.64 to 25.4 cm). Creating distance between the inlet/outlets of the needles can prevent cross contamination/flow between the two lumens.

In some embodiments, a suitable gas pressure is introduced into a bottle to extract beverage from the bottle. For example, with some sparkling wine bottles, it has been found that a maximum pressure of between around 20 and 100 psi (1.4-6.9 bar) may be introduced into the bottle without risking leakage at, or ejection of, the cork, although other pressures may be used. In an alternate embodiment, the system can include a pressure meter that detects the original pressure within the sparkling wine container after insertion of the needle. Such a meter could be arranged such that it was coupled to the valve when the valve was in a position preventing flow of either beverage from the container or gas into the container. The pressure meter acts as a guide to the user as to the appropriate pressure to inject into the bottle following extraction of beverage such that the sparkling wine is left at the original pressure following removal of the needle. Alternatively, an electronic control system can be employed to automatically dispense beverage and pressurize the bottle to its initial pressure prior to needle removal. Any version of a pressure monitoring or control system, either by the user or electronically, could also be used to alter the original pressure of a sealed sparkling wine. Older or vintage sparkling wines frequently lose their carbonation over time due to slow leak through or around the closure or cork. Such wines could be revitalized by injecting gas at a pressure above the pressure to which such a vintage sparkling wine had decayed.

The source of pressurized gas can be any of a variety of regulated or unregulated pressurized gas bottles filled with any of a variety of non-reactive gasses. In a preferred embodiment, the gas cylinder contains gas at an initial pressure of about 2000-3000 psi (138-207 bar). This pressure has been found to allow the use of a single relatively small compressed gas cylinder (e.g., about 3 inches [7.6 cm] in length and 0.75 inches [1.9 cm] in diameter) for the complete extraction of the contents of several bottles of wine. Multiple gasses have been tested successfully over extended storage periods. Preferably the gas used is non-reactive with the beverage within the bottle, such as wine, and can serve to protect the beverage from oxidation or other damage. Suitable gases include nitrogen, carbon dioxide, argon, helium, neon and others. Mixtures of gas are also possible. For example, a mixture of argon and another lighter gas could blanket wine or other beverage in argon while the lighter gas could occupy volume within the bottle and perhaps reduce the overall cost of the gas. Pure carbon dioxide has been found as a preferred gas for most sparkling wine beverages.

In the embodiment above, a single needle with a single lumen is used to introduce gas into the bottle and extract beverage from the bottle. However, in other embodiments two or more needles may be used, e.g., one needle for gas delivery and one needle for beverage extraction. In such an embodiment, the valve(s) may operate to simultaneously open a flow of gas to the bottle and open a flow of beverage from the bottle. The needles may have the same or different diameters or the same or different length varying from 0.25 to 10 inches (0.64 to 25.4 cm). For example, one needle delivering gas could be longer than another that extracts wine from the bottle. Alternately, a two lumen needle may be employed where gas travels in one lumen and beverage travels in the other. Each lumen could have a separate entrance and exit, and the exits could be spaced from each other within the bottle to prevent circulation of gas.

Figure 4A:
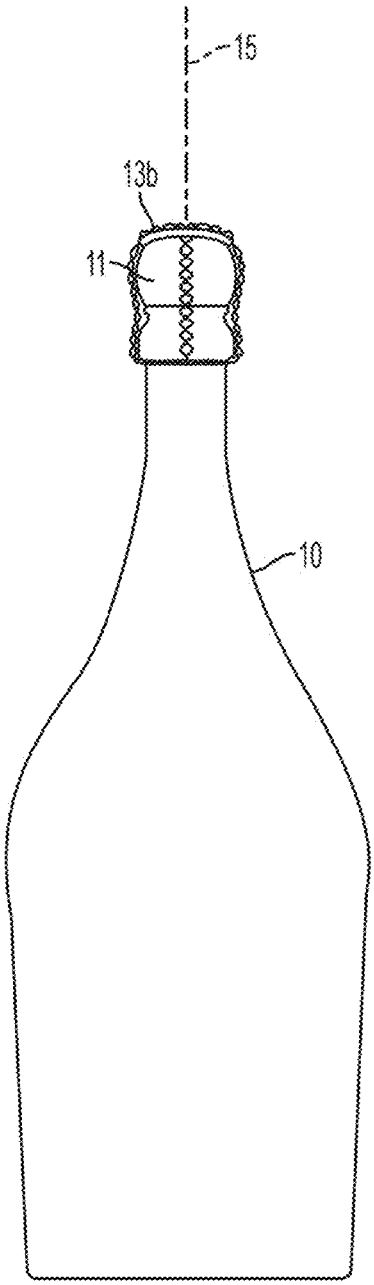
FIG. 4*a* shows a container having a wire retainer and metal cap.
Figure 4B:
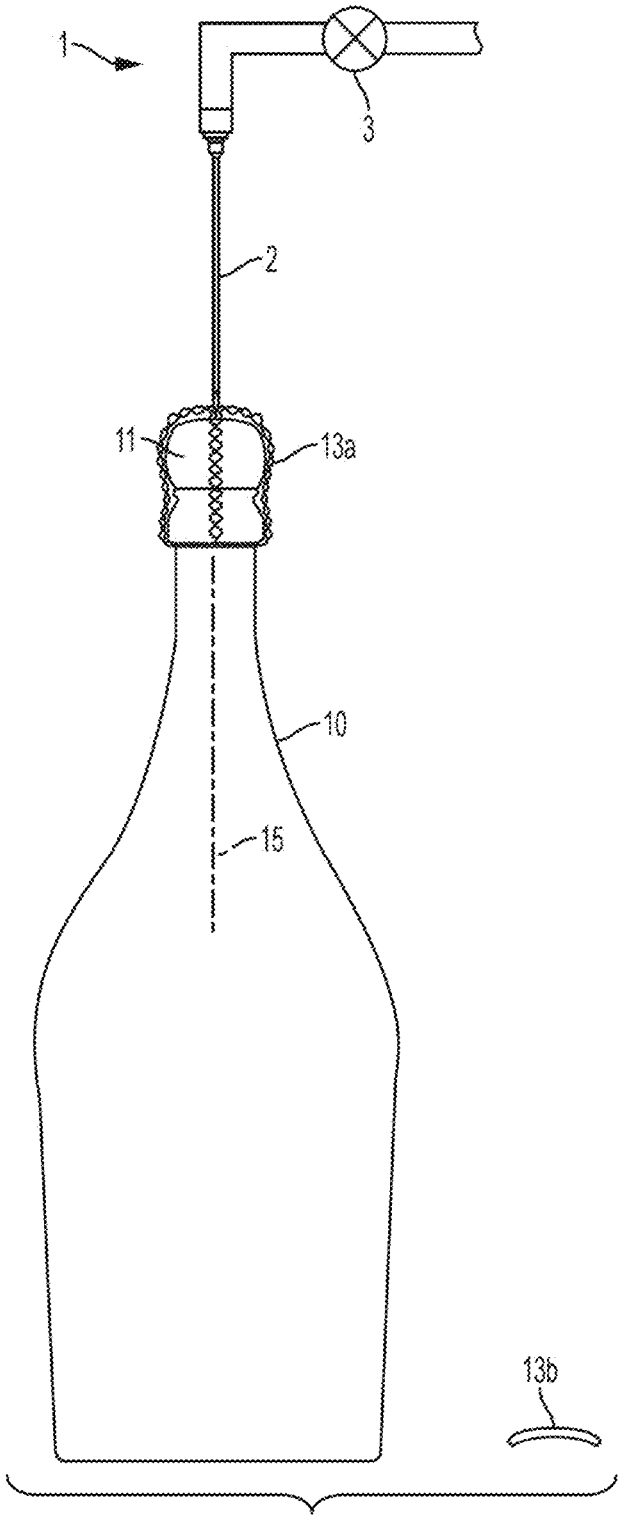
FIG. 4*b* shows the container of FIG. 4*a* after removal of the metal cap but not the wire retainer and subsequent insertion of a needle along a longitudinal axis of the cork.

FIGS. 4*a* and 4*b* depict an alternative method of passing a needle 2 of a beverage extraction apparatus 1 through cork 11. In this method, wire retainer 13*a* is removed from container 10 prior to insertion of the needle. Metal cap 13*b* is then removed from the wire retainer, prior to replacing wire retainer 13*a* onto container 10 so as to retain the cork 11. With the metal cap 13*b* removed, a needle 2 can now be passed directly through cork 11 along the long axis 15 of container 10. FIG. 4*a* depicts container 10 prior to removal of metal cap 13*b*. FIG. 4*b* depicts container 10 following removal of wire retainer 13*a*, removal of metal cap 13*b* and replacement of wire retainer 13*a*. FIG. 4*b* further depicts needle 2 prior to passage through cork 11.

Figure 5A:
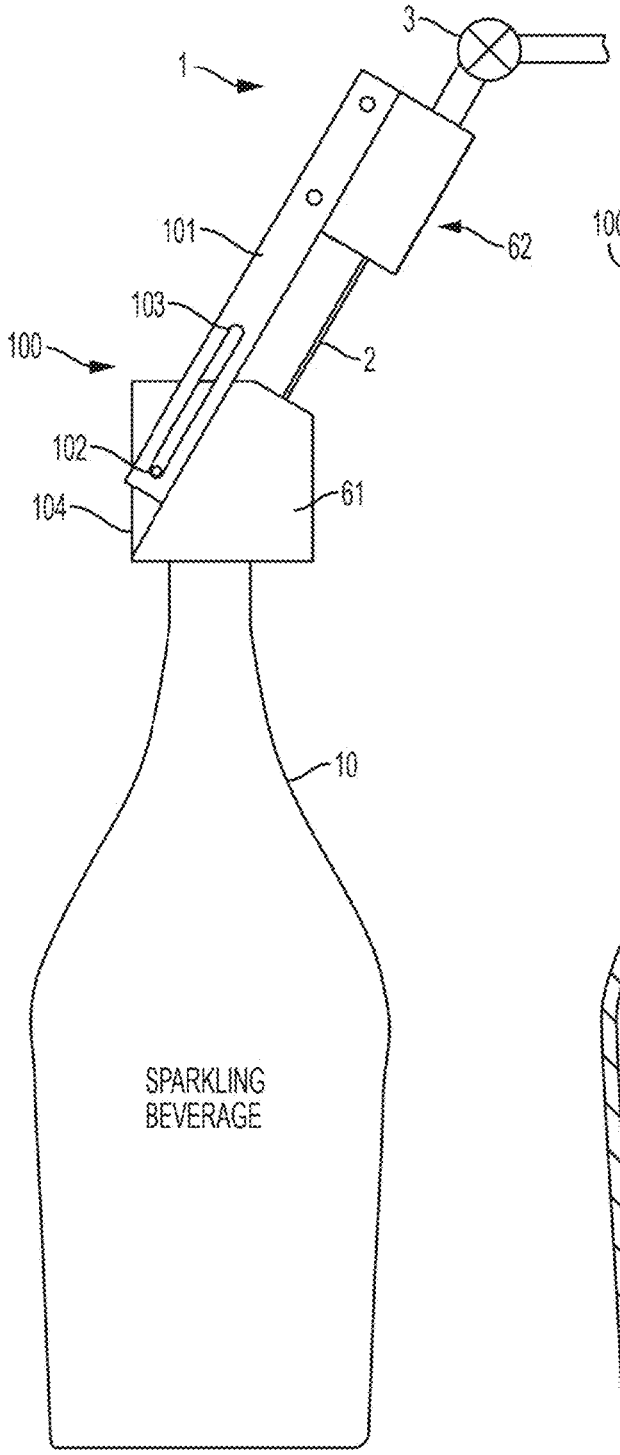
FIG. 5*a* shows a front view of a beverage extraction device in an illustrative embodiment engaged with a container.
Figure 5B:
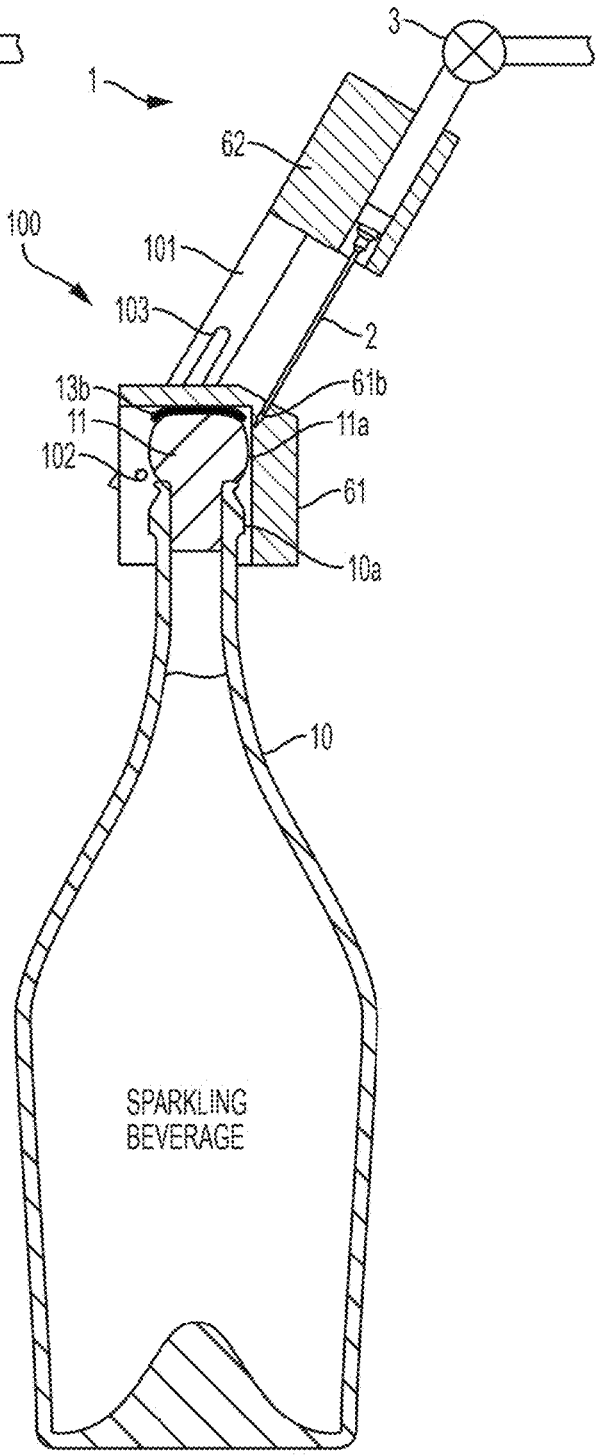
FIG. 5*b* shows a cross sectional view of the extraction device of FIG. 5*a* prior to needle insertion.
Figure 5C:
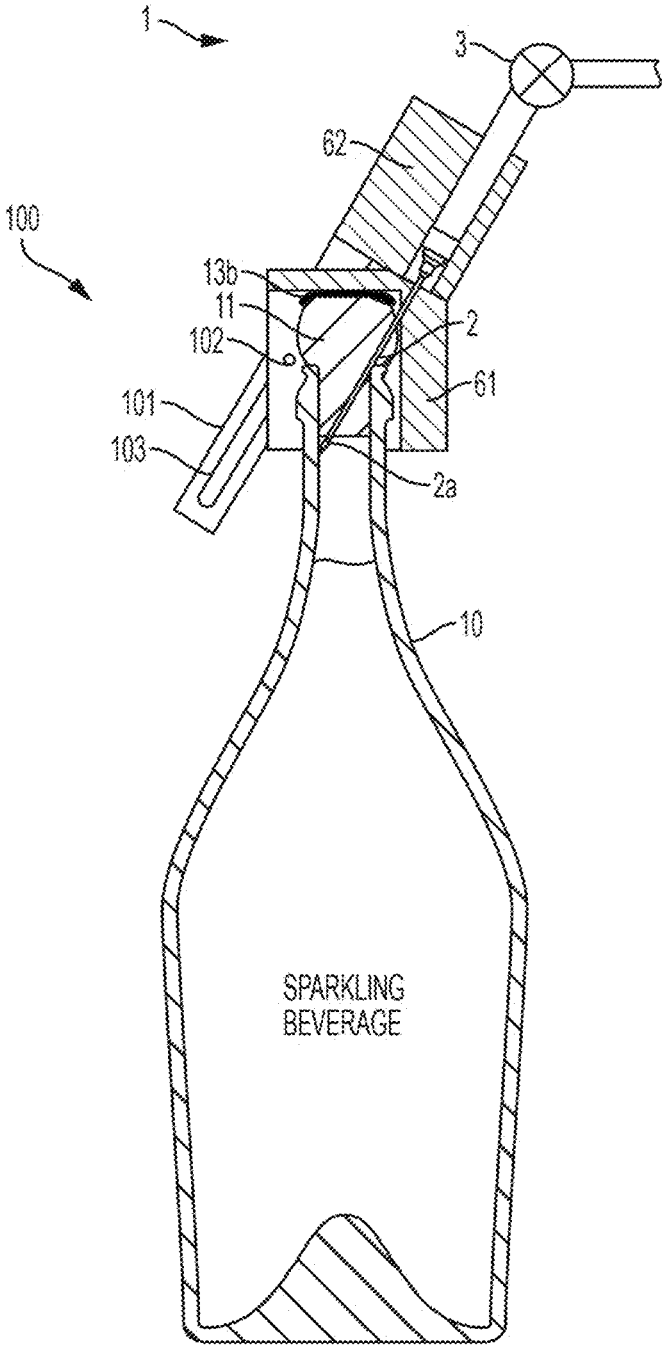
FIG. 5*c* shows a cross sectional view of the extraction device of FIG. 5*a* after needle insertion.

FIGS. 5*a*, 5*b*, and 5*c* depict a rail guide mechanism 100 for a beverage extraction apparatus 1 to enable the guiding of a needle 2 through cork 11 beneath metal cap 13*b*. In FIGS. 5*a*-5*c*, wire retainer 13*a* is not show for clarity of the drawing, but the bottle attachment and needle guide construct does not require the removal of wire retainer 13*a* or metal cap 13*b*. Rail guide mechanism 100 comprises a needle guide 61 which is secured to container 10, and upper housing 62 which is slidably connected to needle guide 61 via a rail or rails 101. Upper housing 62 incorporates an attachment to needle 2 which is fluidly coupled to valve 3 and the remainder of apparatus 1, not shown. Rail or rails 101 comprises a slot 103 that rides over a rod 102. Preferably, rail or rails 101 slide in a mating track 104 in needle guide 61. The length of slot 103 is set to the desired travel of needle 2, from a first position depicted in FIGS. 5*a* and 5*b*, to a second position in FIG. 5*c*. Needle guide 61 positions on container 10 and indexes the trajectory of the needle 2 by touching off on the top of metal cap 13*b* or overlying foil, and either or both of the side of cork 11 in position 11*a* and the side of the neck of the container 10 in or around position 10*a*. Rod 102 passes through needle guide 61 and further acts to restrain motion of needle guide 61 relative to the container by providing purchase against cork 11, preferably near to the insertion of cork 11 into container 10. Needle 2 passes through opening/passage 61*b* as upper housing 62 and rail or rails 101 are advanced toward needle guide 61. Needle 2 continues to advance through the cork until either upper housing 62 contacts needle guide 61 or rod 102 hits an end of slot 102 in rail 101, as depicted in FIG. 5*c*. At this second position, a side hole or holes 2*a* in needle 2 is positioned within container 10 beneath cork 11, allowing flow of gas or beverage through needle 2. Once the desired amount of beverage has been extracted, upper housing 62 can be moved relative to needle guide 61, removing needle 2 from cork 11 until rod 102 hits the other end of slot 103, as depicted in FIGS. 5*a*, 5*b*.

Figure 6:
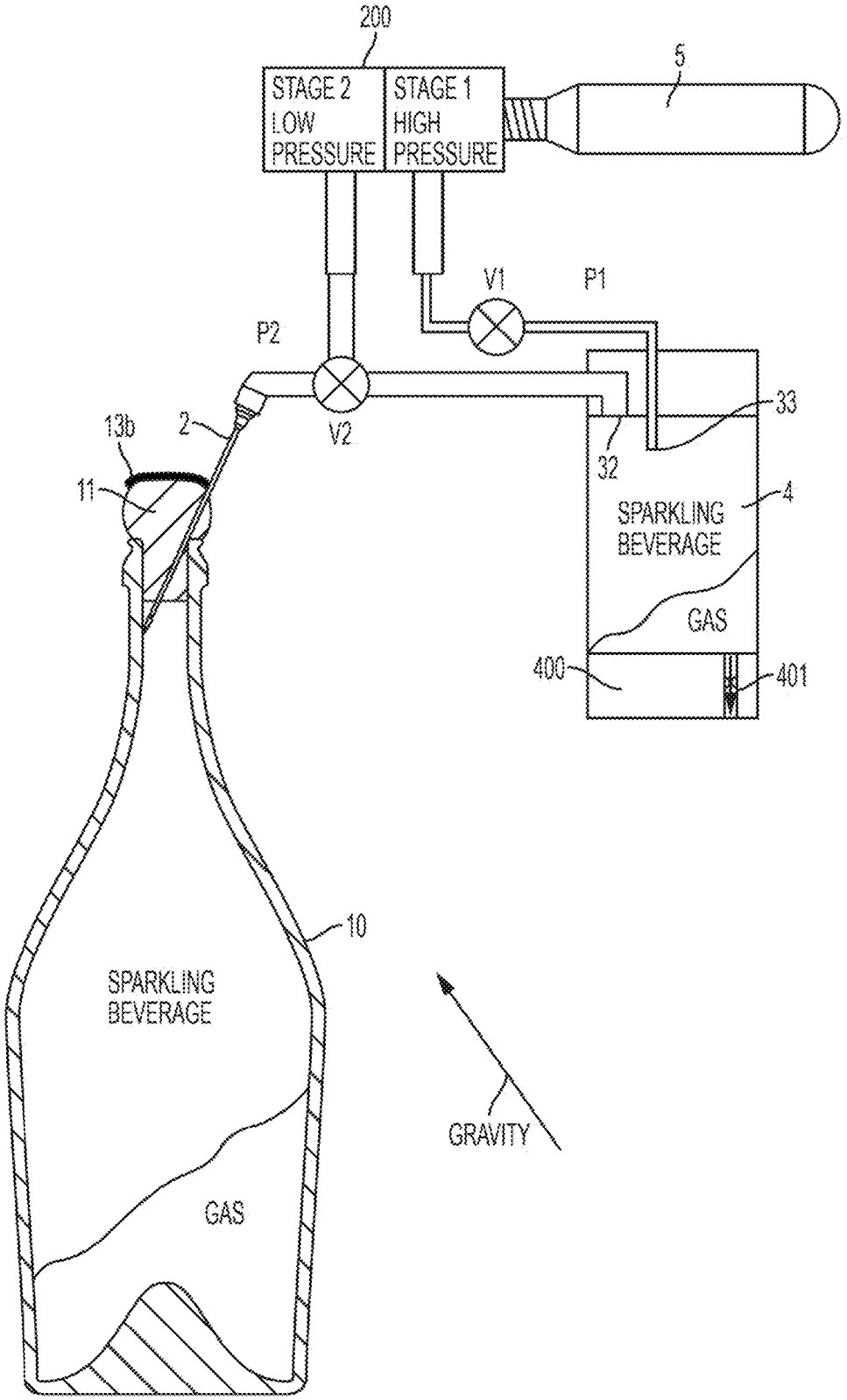
FIG. 6 shows a schematic view of a beverage extraction device having a gas source arranged to provide first and second pressures to a reservoir and a container.

FIG. 6 shows another beverage extraction apparatus 1 for removing a pressurized or sparkling beverage from a container 10 sealed by a cork or other closure 11. Container 10 is shown in section in FIG. 6. In this embodiment, apparatus 1 comprises a reservoir 4, a pressurized source of gas 5, a dual stage regulator 200, a needle 2, a first valve V1 controlling a source of pressurized gas to reservoir 4 through passage 33, a second valve V2 (e.g., a three-way valve) controlling a source of pressurized gas fluidly connected to needle 2 and the flow of beverage from container 10 through needle 2 into reservoir 4 through passage 32. In operation needle 2, is passed through cork 11 with valves V2 and V1 closed to any flow. The needle 2 may be passed through the cork 11 in any suitable way, such as those discussed above. Once container 10 is tilted, placing fluid within container 10 in contact with a side hole or holes 2*a* of needle 2, valve V2 is operated to allow beverage to flow through needle 2 into reservoir 4 (e.g., a BEVERAGE DISPENSE position). Reservoir 4 comprises cap 400 with flow restrictor 401. Flow restrictor 401 allows gas within reservoir 4 to vent as reservoir 4 fills with beverage. Valve V2 can be either manually or automatically actuated (e.g., a SECOND PRESSURE DELIVER position) to re-pressurize container 10 with gas from pressurized gas source 5 during beverage extraction to a desired second pressure P2 regulated by Stage 2 of regulator 200. It has been found that a second pressure P2 of between 20 and 50 psi (1.4 and 3.4 bar) is adequate to ensure flow of beverage from container 10 into reservoir 4. If needle 2 is a single lumen needle, opening of valve V2 to second pressure P2 when V2 is closed to flow into reservoir 4. If needle 2 is a dual lumen needle with one lumen for flow of gas into container 10 and another lumen for flow of fluid into reservoir 4, valve V2 can be open to flow into reservoir 4 during pressurization of container 10 by second pressure P2.

Once reservoir 4 is filled with a desired amount of beverage, valve V2 can be actuated to pressurize container 10 to a desired level, preferably the maximum regulated second pressure P2 output from the second stage of regulator 200 prior to removal of needle 2 from container 10. Prior to opening lid 400, reservoir 4 can be additionally pressurized by opening valve V1 (e.g., a FIRST PRESSURE DELIVER position), allowing flow of gas from pressurized source 5 through Stage 1 of regulator 200. Stage 1 can be set to a first pressure P1 different from P2, and is preferably higher than second pressure P2. It has been found that first pressures P1 between 70 and 120 psi (4.8 and 8.3 bar) can be useful for providing suitable carbonation of the extracted beverage. Valve V1 can be opened either once until a desired pressure is released, or repeatedly at intervals during which gas vents through restrictor 401. Alternatively or in addition, flow restrictor 401 can be closed prior to opening of valve V1 and pressurization of reservoir 4. During pressurization of reservoir 4 with pressure P1, valve V2 is closed.

In beverage extraction apparatus 1 of FIG. 6, passage 32 is shown to be larger than passage 33. Passage 32 is in some embodiments equal to or larger than the fluid lumen of needle 2 to avoid restricting the passage of beverage from container 10. However, passage 33 is in some embodiments is a relatively narrow passage to create a jet of gas at pressure P1. Both passage 32 and 33 are preferably located gravitationally toward the bottom of reservoir 4 as it fills and during pressurization of reservoir 4. The orientation of passage 33 can be as depicted in FIG. 6 or alternatively oriented outward, against the wall orthogonal the direction of filing.

In alternative embodiments of the apparatus 1 shown in FIG. 6, a single pressure can be used both to pressurize the container as well as to pressurize the reservoir once it has been filled to a desired level. Activation of the valves in FIG. 6 can be done manually by the user, or with an automatic control system which may comprise pressure and or volume sensors which sense the pressure or volume in the container and/or reservoir. For example, a sensor may detect pressure in the container 10 and automatically open/close valve V2 to maintain a desired level of pressure in the container.

Figure 7:
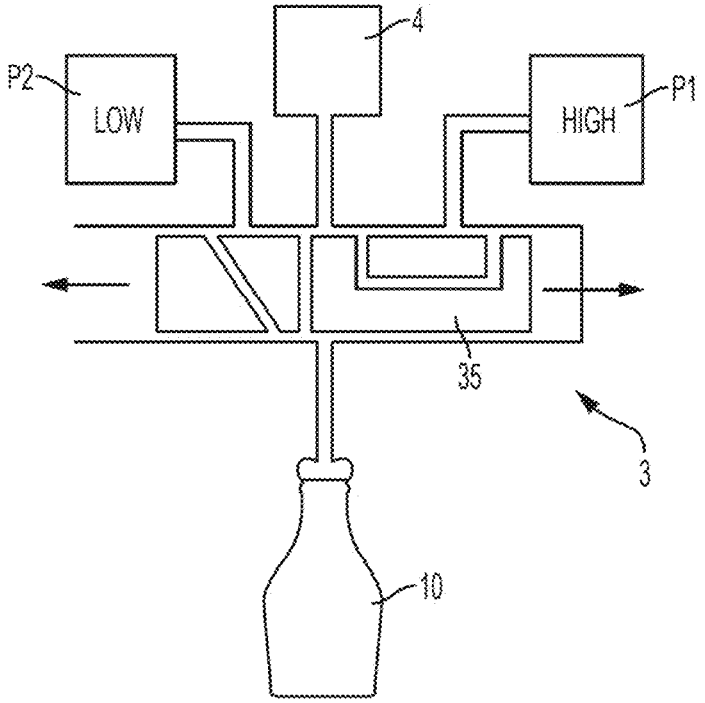
FIG. 7 shows a schematic view of a flow control valve for providing first and second gas pressures and beverage flow.

FIG. 7 shows a schematic view of flow control valve 3 that could be used in the FIG. 6 embodiment. In this arrangement, the valve 3 includes a movable valve element 35, such as a valve spool, that can be moved between OFF, BEVERAGE DISPENSE, FIRST PRESSURE DELIVER and SECOND PRESSURE DELIVER positions. The movable element may be spring biased or a detent may be provided to tend to keep the movable element 35 in the OFF position shown in FIG. 7 such that no gas or beverage flow may occur. This position may be useful when inserting a needle 2 into a bottle cork 11, preparing to dispense beverage and/or removing a needle from a cork. The movable element 35 may be moved along a linear path to the BEVERAGE DISPENSE position (to the right in FIG. 7) in which the container 10 is fluidly coupled to the reservoir 4 (i.e., the valve V2 in FIG. 6 is open to allow for beverage flow to the reservoir 4). From the BEVERAGE DISPENSE position, the movable element 35 may be moved to the SECOND PRESSURE DELIVER position (to the right in FIG. 7, i.e., the valve V2 in FIG. 6 is arranged to deliver gas to the container 10 at the second pressure, e.g., around 20-30 psi). By moving the movable element between the FIRST PRESSURE DELIVER and BEVERAGE DISPENSE positions, a user can alternately dispense beverage to the reservoir 4 and re-pressurize the container 10 if needed to drive additional beverage flow. When dispensing is complete, the movable element 35 may be moved to the OFF position shown in FIG. 7. If carbonation is lost in the beverage dispensed to the reservoir 4, the movable element may be moved to the FIRST PRESSURE DELIVER position (to the left in FIG. 7, i.e., in which the valve V1 in FIG. 6 is opened to deliver gas at the first pressure to the reservoir 4, e.g., at 50-100 psi). By pressurizing the reservoir 4, additional carbon dioxide may be dissolved in the beverage if desired. Since the valve V2 is closed in the FIRST PRESSURE DELIVER position of the movable element 35, relatively high pressure gas is not delivered to the container 10. This way, any risk of expelling the cork or other problems caused by high pressure in the container 10 may be avoided.

Figure 8:
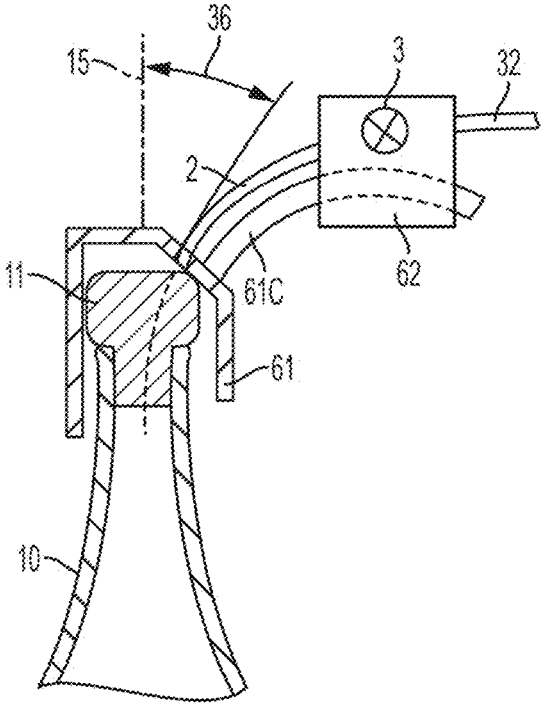
FIG. 8 shows a beverage extraction device with a curved needle and needle guide.

FIG. 8 shows a beverage extraction apparatus 1 arranged in a way similar to that in FIG. 5*a*, except that the needle 2 in this embodiment is curved. A curved needle may provide advantages when inserting a needle 2 through a cork 11 that has a wire retainer and metal cap 13. That is, the curved needle may follow a path such that the metal cap of the retainer 13, as well as the bottle lip and portions at the bottle opening, are avoided so that the distal end of the needle 2 may enter into the container space below cork 11. The beverage extraction apparatus 1 may include a curved needle guide, e.g., guide rod 61*c*, to help guide movement of the needle 2 through the cork 11 in much the same way as described above, although guiding the needle along a curved path through the cork 11. That is, in this embodiment, the upper housing 62 may be guided in its movement relative to the needle guide 61 by one or more curved rods 61*c*, which guide motion of the curved needle 2 into the cork 11. As can be seen in FIG. 8, the distal end of the needle 2 enters the cork 11 along a direction that is arranged at an angle 36 to the longitudinal axis 15 of the container 10, e.g., where the angle is between 5 and 70 degrees.

While aspects of the invention have been shown and described with reference to illustrative embodiments, it will be understood by those skilled in the art that various changes in form and details may be made therein without departing from the scope of the invention encompassed by the appended claims.

The invention claimed is:

1. A sparkling beverage dispensing system for use with a container having beverage and gas in an interior, an opening to the interior with a closure positioned in the opening and a cap and wire retainer securing the closure to the container, the system comprising:

at least one needle arranged to penetrate through the closure such that a distal end of the needle is positioned inside of the container, the needle being arranged to receive beverage from the container for dispensing;

a needle guide arranged to engage the container and guide the at least one needle in penetrating through the closure, the needle guide arranged to guide the at least one needle to enter the closure at an angle of 5 degrees to 70 degrees relative to a longitudinal axis of the container; and at least one valve fluidly coupled to the at least one needle to control beverage flow out of the container via the at least one needle to a dispensing outlet, wherein the at least one needle and the needle guide are arranged to position the distal end of the at least one needle inside the container upon full insertion of the at least one needle through the closure such that with the longitudinal axis of the container in a vertical orientation the distal end is in contact with the gas in the container and is out of contact with the beverage in the container.

2. The system of claim 1, wherein the at least one needle is arranged to penetrate a cork closure of a sparkling wine bottle and be withdrawn from the cork closure such that the cork closure reseals.

3. The system of claim 1, further comprising a reservoir arranged to fluidly couple with the dispensing outlet and receive beverage dispensed from the dispensing outlet, the reservoir arranged to hold dispensed beverage under pressure.

4. The system of claim 3, wherein the reservoir is fluidly coupled to the dispensing outlet so that a pressure in the reservoir equalizes with a pressure in the container.

5. The system of claim 4, wherein the reservoir is arranged to vent to ambient pressure before or at a time of dispensing the beverage from the reservoir to a user's cup.

6. The system of claim 5, wherein the reservoir includes a dispensing valve arranged to open to vent the reservoir and dispense the beverage in the reservoir.

7. The system of claim 3, wherein the reservoir is arranged to vent pressure in the reservoir at a rate of no more than 5 psi/sec when in a closed state.

8. The system of claim 3, wherein the reservoir includes a lid that is removable to allow beverage in the reservoir to be poured from the reservoir.

9. The system of claim 8, wherein the lid includes a coupling arranged to engage with the dispensing outlet and receive beverage into the reservoir.

10. The system of claim 3, wherein beverage enters the reservoir at a bottom of the reservoir.

11. The system of claim 3, wherein the reservoir is arranged to dispense beverage from an outlet at a bottom of the reservoir.

12. The system of claim 1, further comprising a source of pressurized gas, and the at least one valve includes a gas control valve to allow a flow of pressurized gas from the source of pressurized gas into the container via the at least one needle.

13. The system of claim 12, wherein the at least one valve includes a beverage dispensing valve to control flow of beverage from the at least one needle to the dispensing outlet, and wherein the gas control valve permits flow of pressurized gas only when the beverage dispensing valve is closed.

14. The system of claim 1, wherein the at least one valve includes a normally closed beverage dispensing valve that prevents flow of beverage from the at least one needle to the dispensing outlet absent user action to open the normally closed valve.

15. The system of claim 1, wherein the at least one needle and the needle guide are arranged such that the needle follows a linear path through the closure along a direction that is 5 to 45 degrees from the longitudinal axis.

16. The system of claim 1, wherein the at least one needle is curved, and the needle guide is arranged to guide the at least one needle to follow a curved path through the closure.

17. The system of claim 16, wherein the at least one needle has a constant curvature.

18. The system of claim 16, wherein the at least one needle and the needle guide are arranged such that the at least one needle avoids contact with the container when penetrating the closure.

19. The system of claim 1, wherein the at least one needle includes a first needle arranged to deliver pressurized gas to the container and a second needle arranged to deliver beverage from the container.

20. A method for dispensing beverage from a container having beverage and gas in an interior, an opening to the interior with a closure positioned in the opening and a cap and retainer securing the closure to the container, the method comprising:

penetrating through the closure with at least one needle at an angle of 5 degrees to 70 degrees relative to a longitudinal axis of the container such that a distal end of the needle is positioned inside of the container, the distal end of the needle being positioned such that with the longitudinal axis of the container in a vertical orientation the distal end is in contact with the gas in the container and is out of contact with the beverage in the container;

tilting the container so that the beverage in the container contacts the distal end of the needle; and operating at least one valve that is fluidly coupled to the at least one needle to control beverage flow out of the container via the at least one needle to a dispensing outlet.

21. The method of claim 20, wherein the at least one needle penetrates a cork closure of a sparkling wine bottle.

22. The method of claim 21, further comprising withdrawing the at least one needle from the cork closure such that the cork closure reseals upon withdrawal of the at least one needle.

23. The method of claim 20, further comprising delivering beverage from the dispensing outlet to a reservoir fluidly coupled with the dispensing outlet, the reservoir arranged to hold dispensed beverage under pressure.

24. The method of claim 23, wherein the reservoir is fluidly coupled to the dispensing outlet so that a pressure in the reservoir equalizes with a pressure in the container.

25. The method of claim 23, wherein the reservoir is arranged to vent to ambient pressure before or at a time of dispensing the beverage from the reservoir to a user's cup.

26. The method of claim 23, wherein the reservoir includes a dispensing valve arranged to open to vent the reservoir and dispense the beverage in the reservoir.

27. The method of claim 26, wherein the reservoir is arranged to vent pressure in the reservoir at a rate of no more than 5 psi/sec when in a closed state.

28. The method of claim 23, wherein the reservoir includes a lid that is removable to allow beverage in the reservoir to be poured from the reservoir.

29. The method of claim 28, wherein the lid includes a coupling arranged to engage with the dispensing outlet and receive beverage into the reservoir.

30. The method of claim 23, wherein beverage enters the reservoir at a bottom of the reservoir.

31. The method of claim 23, wherein the reservoir is arranged to dispense beverage from an outlet at a bottom of the reservoir.

32. The method of claim 20, further comprising operating the at least one valve to allow a flow of pressurized gas from a source of pressurized gas into the container via the at least one needle.

33. The method of claim 20, wherein the at least one valve includes a beverage dispensing valve to control flow of beverage from the at least one needle to the dispensing outlet.

34. The method of claim 20, wherein the at least one valve includes a normally closed beverage dispensing valve that prevents flow of beverage from the at least one needle to the dispensing outlet absent user action to open the normally closed valve.

35. The method of claim 20, wherein the at least one needle follows a linear path through the closure along a direction that is 5 to 45 degrees from the longitudinal axis.

36. The method of claim 20, wherein the at least one needle is curved, and the at least one needle follows a curved path through the closure.

37. The method of claim 20, wherein the at least one needle is arranged such that the at least one needle avoids contact with the container when penetrating the closure.

38. The method of claim 20, wherein the at least one needle includes a first needle arranged to deliver pressurized gas to the container and a second needle arranged to deliver beverage from the container.

* * * * *